US012054810B2

(12) United States Patent
Kang et al.

(10) Patent No.: US 12,054,810 B2
(45) Date of Patent: Aug. 6, 2024

(54) Al—Mg—Si-BASED ALUMINUM ALLOY SHEET EXCELLENT IN FORMABILITY

(71) Applicant: Kobe Steel, Ltd., Kobe (JP)

(72) Inventors: Shiwei Kang, Moka (JP); Ryutaro Akiyoshi, Moka (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 17/402,050

(22) Filed: Aug. 13, 2021

(65) Prior Publication Data

US 2022/0056559 A1 Feb. 24, 2022

(30) Foreign Application Priority Data

Aug. 24, 2020 (JP) ..... 2020-141228

(51) Int. Cl.
*C22C 21/02* (2006.01)
*C22F 1/043* (2006.01)

(52) U.S. Cl.
CPC ..... *C22C 21/02* (2013.01); *C22F 1/043* (2013.01)

(58) Field of Classification Search
CPC ..... C22C 21/14; C22C 21/02; C22C 21/16; C22F 1/043
See application file for complete search history.

(56) References Cited

U.S. PATENT DOCUMENTS

| | | | |
|---|---|---|---|
| 9,453,273 | B2 | 9/2016 | Matsumoto et al. |
| 2018/0187293 | A1 | 7/2018 | Shishido et al. |
| 2019/0127825 | A1 | 5/2019 | Shishido et al. |

FOREIGN PATENT DOCUMENTS

| | | | | |
|---|---|---|---|---|
| CN | 104114726 | A | 10/2014 | |
| JP | 6190307 | B2 | 8/2017 | |
| JP | 2017-179470 | A | 10/2017 | |
| JP | 6306123 | B2 | 4/2018 | |
| KR | 10-2016-0127113 | A | 11/2016 | |
| WO | WO-2006056481 | A1 * | 6/2006 | ..... B62J 17/08 |

* cited by examiner

*Primary Examiner* — Jessee R Roe
(74) *Attorney, Agent, or Firm* — Oblon, McClelland, Maier & Neustadt, L.L.P.

(57) ABSTRACT

To provide an Al—Mg—Si-based aluminum alloy sheet excellent in formability with excellent breaking elongation and work hardenability.

An Al—Mg—Si-based aluminum alloy sheet excellent in formability contains Mg: 0.3 mass % or more and 0.45 mass % or less and Si: 0.6 mass % or more and 1.75 mass % or less with the balance being Al and inevitable impurities, in which, when content of the Mg is expressed [Mg] in terms of mass % and content of the Si is expressed [Si] in terms of mass %, [Si]/[Mg] is more than 2.5, a height of a first exothermic peak appearing in a temperature range of 210° C. or above and below 260° C. in a differential scanning thermal analysis curve is 20 μW/mg or more, and a height of a second exothermic peak appearing in a temperature range of 260° C. or above and 370° C. or below in a differential scanning thermal analysis curve is 18 μW/mg or more.

11 Claims, 1 Drawing Sheet

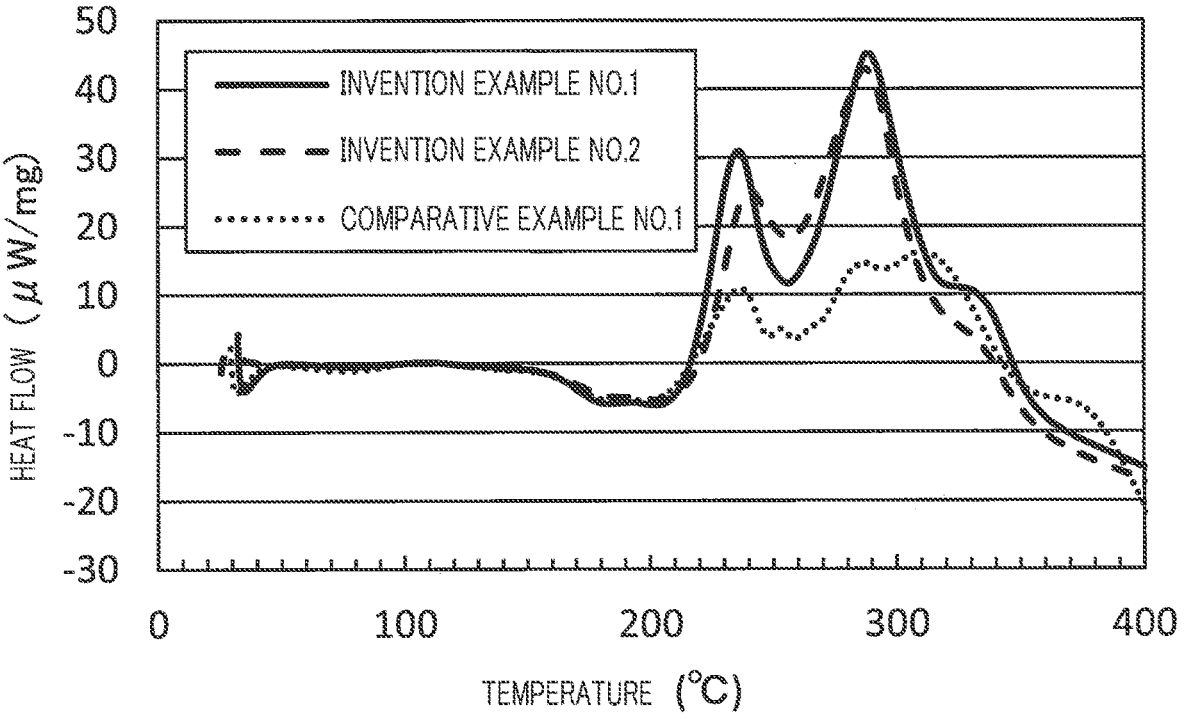
50
40
30
20
10
0
-10
-20
-30
HEAT FLOW (μW/mg)
INVENTION EXAMPLE NO.1
INVENTION EXAMPLE NO.2
COMPARATIVE EXAMPLE NO.1
0
100
200
300
400
TEMPERATURE (°C)

Al—Mg—Si-BASED ALUMINUM ALLOY SHEET EXCELLENT IN FORMABILITY

TECHNICAL FIELD

The present invention relates to an Al—Mg—Si-based aluminum alloy sheet excellent in formability which is a 6000 series aluminum alloy sheet manufactured by ordinary rolling and is excellent in both breaking elongation and work hardenability.

BACKGROUND ART

In recent years, out of consideration for global environment and the like, the social demand of weight reduction of the vehicle body of the automobile has been increasing more than ever. To cope with such demand, an aluminum alloy material has been applied to large body panels (outer panel, inner panel) out of the vehicle body of the automobile instead of an iron and steel material such as a steel plate having been used so far.

Out of the large body panels described above, for the panel such as the outer panel (outer sheet) and the inner panel (outer sheet) of a panel structural body such as the hood, fender, door, roof, and trunk lid, the Al—Mg—Si-based AA or JIS 6000 series (will be hereinafter simply referred to also as 6000 series) aluminum alloy sheet has been used as a thin and high-strength aluminum alloy sheet.

This 6000 series (Al—Mg—Si-based) aluminum alloy sheet indispensably contains Si and Mg. Particularly, an excess Si type 6000 series aluminum alloy sheet has age hardenability excellent in artificial temper aging treatment.

Since these automotive panel materials are generally subjected to press forming, excellent formability is required for the aluminum alloy sheets to be applied. In recent years, since the body design and the character line become more diversified, edgier, and more complicated, the cases of more complicated press forming and severer working condition have been increasing, and it has been required to improve press formability further more.

For example, in "Trends and Formability Issues related to Aluminum Sheet Alloy used for Automotive Body Panels", Takeo Sakurai and another, R&D Kobe Seiko Giho (R&D KOBE STEEL ENGINEERING REPORTS), 2001, Vol. 51, No. 1, p. 9-12 (Non-patent Literature 1), it is described that, in order to improve press formability of the Al—Mg—Si-based alloy, it is required to improve breaking elongation and work hardenability.

Also, from the past, with respect to the 6000 series aluminum alloy sheet as a raw material of such automotive members, various methods for controlling the Mg—Si-based cluster have been studied. To be more specific, the methods for achieving both high paint bake hardenability and high formability by high breaking elongation and low yield strength by controlling the exothermic peak indicating the cluster and the strengthening phase have been proposed.

For example, in "Recent studies on aging phenomena of 6000 series aluminum alloys", Kenji Matsuda and another, Keikinzoku (Light Metals), Japan, The Japan Institute of Light Metals, 2000, Vol. 50, No. 1, p. 23-36, it is described that, in an excess Si type Al—Mg—Si-based alloy, the alloy structure can be controlled by controlling the exothermic peak height in differential scanning calorimetry (DSC) based on that various precipitated phases such as the GP zone (Guinier-Preston zone), strengthening phase, intermediate phase, and equilibrium phase are formed accompanying rising of the temporal temperature.

Also, in Japanese Patent No. 6306123, an aluminum alloy sheet excellent in formability and paint bake hardenability is disclosed which is characterized that an endothermic peak whose height A is 3-10 μW/mg exists within the temperature range of 150-230° C. in the differential scanning thermal analysis curve, an exothermic peak whose height B is 20-50 μW/mg exists within the temperature range of 230° C. or above and lower than 330° C., and the ratio B/A of the height B of the exothermic peak and the height A of the endothermic peak is more than 3.5 and less than 15.0.

Also, in Japanese Patent No. 6190307, an aluminum alloy sheet is disclosed in which the differential scanning thermal analysis curve has, in a temperature range of 230-330° C., only one exothermic peak (i) or only two exothermic peaks (ii) having a temperature difference between the two peaks of 50° C. or less, and the exothermic peak (i) or the peak having a higher peak height of the exothermic peaks (ii) has a height in a range of 20-50 μW/mg.

SUMMARY OF INVENTION

However, according to the technology of the prior art described above, when Mg is added and age hardenability is improved aiming to achieve both age hardenability and breaking elongation, there comes up a problem of deterioration of breaking elongation. Therefore, in order to improve formability, it is required to improve breaking elongation and work hardenability.

The present invention has been achieved in view of such problem, and its object is to provide an Al—Mg—Si-based aluminum alloy sheet excellent in formability in which both breaking elongation and work hardenability are excellent.

An Al—Mg—Si-based aluminum alloy sheet excellent in formability related to the present invention has a configuration of (1) described below.

(1) An Al—Mg—Si-based aluminum alloy sheet excellent in formability, containing:

Mg: 0.3 mass % or more and 0.45 mass % or less; and

Si: 0.6 mass % or more and 1.75 mass % or less, with the balance being Al and inevitable impurities, in which when content of the Mg is expressed [Mg] in terms of mass % and content of the Si is expressed [Si] in terms of mass %, [Si]/[Mg] is more than 2.5, a height of a first exothermic peak appearing in a temperature range of 210° C. or above and below 260° C. in a differential scanning thermal analysis curve is 20 μW/mg or more, and a height of a second exothermic peak appearing in a temperature range of 260° C. or above and 370° C. or below in a differential scanning thermal analysis curve is 18 μW/mg or more.

Also, a preferable embodiment of the Al—Mg—Si-based aluminum alloy sheet excellent in formability related to the present invention has a configuration of (2) described below.

(2) The Al—Mg—Si-based aluminum alloy sheet excellent in formability according to (1), further containing:

at least one element selected from Cu, Fe, Mn, and Ti within a range of

Cu: more than 0 mass % and 0.8 mass % or less,

Fe: 0.05 mass % or more and 0.5 mass % or less,

Mn: 0.05 mass % or more and 0.3 mass % or less, and

Ti: more than 0 mass % and 0.1 mass % or less.

ADVANTAGEOUS EFFECTS OF INVENTION

According to the present invention, it is possible to provide an Al—Mg—Si-based aluminum alloy sheet excellent in formability in which both breaking elongation and work hardenability are excellent.

BRIEF DESCRIPTION OF DRAWING

FIG. 1 is a graph showing the differential scanning thermal analysis curves of the invention example No. 1, the invention example No. 2, and the comparative example No. 1.

DESCRIPTION OF EMBODIMENTS

Embodiments of the present invention will be hereinafter explained in detail. Also, the present invention is not limited to the embodiments hereinafter explained, and can be implemented to be changed optionally within a range not departing from the gist of the present invention. Further, in the present description, "-" showing a numerical range is used in a meaning of including numerical values described before and after thereof as the lower limit value and the upper limit value.

As a result of intensive studies for solving the problem described above, the present inventors found out that it was effective to increase the Si content and to reduce the Mg content compared to the aluminum alloy sheets of prior arts and to appropriately control the ratio of the Si content and the Mg content in the aluminum alloy sheet. That is to say, an exothermal peak (a second exothermal peak) whose peak height is 18 μW/mg or more in a temperature range of 260° C. or above and 370° C. or below in a differential scanning thermal analysis curve can be obtained, and thereby breaking elongation and work hardenability can be improved.

Also, heat treatment of quenching treatment and cooling to the room temperature after solution treatment and retaining, within one hour thereafter, for 5 hours or more and 500 hours or less at a temperature range of 30° C.-100° C. is executed, or heat treatment of quenching treatment and cooling to the room temperature after solution treatment and retaining, within one hour thereafter, for 5 seconds or more and 300 seconds or less at a temperature range of 100° C.-300° C. is executed and heat treatment of retaining for 5 hours or more and 500 hours or less at a temperature range of 30° C.-100° C. is executed, thereby an exothermal peak (a first exothermal peak) whose peak height is 20 μW/mg or more in a temperature range of 210° C. or above and below 260° C. can be obtained, and thereby desired breaking elongation can be secured and work hardenability can be improved.

That is to say, an Al—Mg—Si-based aluminum alloy sheet excellent in formability related to an embodiment of the present invention contains Mg: 0.3 mass % or more and 0.45 mass % or less and Si: 0.6 mass % or more and 1.75 mass % or less, with the balance being Al and inevitable impurities, in which, when content of Mg is expressed [Mg] in terms of mass % and content of Si is expressed [Si] in terms of mass %, [Si]/[Mg] is more than 2.5, a height of a first exothermic peak appearing in a temperature range of 210° C. or above and below 260° C. in a differential scanning thermal analysis curve is 20 μW/mg or more, and a height of a second exothermic peak appearing in a temperature range of 260° C. or above and 370° C. or below in a differential scanning thermal analysis curve is 18 μW/mg or more.

The aluminum alloy sheet (forming raw material sheet) mentioned in the present invention means a rolled sheet such as a hot rolled sheet and a cold rolled sheet, is a sheet obtained by subjecting this rolled sheet to temper (T4) such as the solution treatment and the quenching treatment, and is a raw material aluminum alloy sheet before being formed into an automotive member and before being subjected to artificial temper aging treatment (artificial age hardening treatment) such as the paint bake hardening treatment.

Embodiments of the present invention will be hereinafter explained more specifically.

The chemical composition of the Al—Mg—Si-based aluminum alloy sheet excellent in formability related to the present invention is determined in order to satisfy desired formability and paint bake hardenability from the composition of the 6000 series aluminum alloy sheet as a raw material for automotive members such as a large automotive body panel.

From this viewpoint, the chemical composition of the Al—Mg—Si-based aluminum alloy sheet excellent in formability related to the present invention contains Mg: 0.3 mass % or more and 0.45 mass % or less and Si: 0.6 mass % or more and 1.75 mass % or less with the balance being Al and inevitable impurities, in which, when content of the Mg is expressed [Mg] in terms of mass % and content of the Si is expressed [Si] in terms of mass %, [Si]/[Mg] is more than 2.5.

Also, the Al—Mg—Si-based aluminum alloy sheet excellent in formability related to the present invention may further contain at least one element selected from Cu, Fe, Mn, and Ti within a range of Cu: more than 0 mass % and 0.8 mass % or less, Fe: 0.05 mass % or more and 0.5 mass % or less, Mn: 0.05 mass % or more and 0.3 mass % or less, and Ti: more than 0 mass % and 0.1 mass % or less.

The chemical composition of the Al—Mg—Si-based aluminum alloy sheet excellent in formability related to the present invention will be hereinafter explained in detail including the reason for limiting each element.

(Si: 0.6 Mass % or More and 1.75 Mass % or Less)

Along with Mg, Si exerts solid solution strengthening and temper aging hardenability forming the temper aging precipitates such as the Mg—Si-based precipitates that contribute to improvement of the strength at the time of the artificial temper aging treatment such as the paint bake treatment. Also, as the Si content in the alloy increases, breaking elongation and work hardenability increase. Therefore, Si is an indispensable element for obtaining the required strength (yield strength), breaking elongation, and work hardenability.

When the Si content in the aluminum alloy sheet is less than 0.6 mass %, the breaking elongation deteriorates and the forming amount of the Mg—Si-based precipitates after artificial temper aging heat treatment becomes insufficient, therefore BH (bake hardening) property deteriorates considerably, and the strength becomes insufficient. Accordingly, the Si content in the aluminum alloy sheet is made to be 0.6 mass % or more, is preferably 1.0 mass % or more with respect to the total mass of the aluminum alloy sheet, and is more preferably 1.2 mass % or more.

On the other hand, when the Si content in the aluminum alloy sheet exceeds 1.75 mass %, coarse Si-based precipitates are formed and the ductility deteriorates, causing cracking in forming the raw material sheet. Therefore, with respect to the total mass of the aluminum alloy sheet, the Si content in the aluminum alloy sheet is made to be 1.75 mass % or less, preferably 1.6 mass % or less, and more preferably 1.5 mass % or less.

(Mg: 0.3 Mass % or More and 0.45 Mass % or Less)

Along with Si, Mg also exerts solid solution strengthening and temper aging hardenability forming the temper aging precipitates such as the Mg—Si-based precipitates that contribute to improvement of the strength at the time of the artificial temper aging heat treatment such as the paint bake treatment, and is an indispensable element for obtaining the required strength.

When the Mg content in the aluminum alloy sheet is less than 0.3 mass %, since the forming amount of the Mg—Si-based precipitates becomes insufficient, BH property extremely deteriorates, and the strength becomes insufficient. Accordingly, the Mg content in the aluminum alloy sheet is made to be 0.3 mass % or more with respect to the total mass of the aluminum alloy sheet.

On the other hand, when the Mg content in the aluminum alloy sheet exceeds 0.45 mass %, the strength of the raw material in forming increases, and breaking elongation and work hardenability deteriorate. Therefore, the Mg content in the aluminum alloy sheet is made to be 0.45 mass % or less with respect to the total mass of the aluminum alloy sheet.

([Si]/[Mg]: More than 2.5)

The present inventors found out that, as the added Mg amount was less with respect to the added Si amount, the solid solution Si amount increased. That is to say, it was found out that the solid solution Si amount could be coordinated by the ratio of the Si content and the Mg content, the ratio being an index of the solid solution Si amount, and it was found out that, by appropriately limiting the value of the ratio, desired breaking elongation could be obtained.

When the content of Mg in the aluminum alloy sheet with respect to the total mass of the aluminum alloy sheet is expressed [Mg] in terms of mass % and the content of Si with respect to the total mass of the aluminum alloy sheet is expressed [Si] in terms of mass %, if [Si]/[Mg] is 2.5 or less, the Si content becomes small with respect to the Mg content, the solid solution Si amount reduces, and therefore the breaking elongation deteriorates. Therefore, [Si]/[Mg] is made to be more than 2.5, is preferably 2.7 or more, and is more preferably 3.0 or more.

The Al—Mg—Si-based aluminum alloy sheet excellent in formability related to the present invention contains Si by 0.6 mass % or more and 1.75 mass % or less and Mg by 0.3 mass % or more and 0.45 mass % or less with the balance being Al and inevitable impurities, but may contain at least one element selected from Cu, Fe, Mn, and Ti other than Si and Mg described above.

These elements commonly have an effect of increasing the strength of the aluminum alloy sheet, can be therefore regarded to be elements having the similar effect in the present invention, and are contained selectively according to the needs; however, it is a matter of course that the concrete mechanism thereof has both a common portion and a different portion.

(Cu: More than 0 Mass % and 0.8 Mass % or Less)

Cu is a component capable of improving the strength by solid solution strengthening. When the Cu content in the aluminum alloy sheet is more than 0 mass % with respect to the total mass of the aluminum alloy sheet, the effect can be obtained. Therefore, when Cu is to be contained in the aluminum alloy sheet, the Cu content is made to be more than 0 mass % with respect to the total mass of the aluminum alloy sheet, is preferably 0.02 mass % or more, and more preferably 0.1 mass % or more.

On the other hand, when the Cu content in the aluminum alloy sheet exceeds 0.8 mass % with respect to the total mass of the aluminum alloy sheet, not only the effect described above saturates, but also the corrosion resistance property of the aluminum alloy sheet may possibly deteriorate. Therefore, when Cu is to be contained in the aluminum alloy sheet, the Cu content is made to be 0.8 mass % or less with respect to the total mass of the aluminum alloy sheet, and preferably 0.6 mass % or less.

(Fe: 0.05 Mass % or More and 0.5 Mass % or Less)

Fe forms a chemical compound, becomes nuclei of the recrystallized grain, refines the grain, and improves the strength. When the Fe content in the aluminum alloy sheet is 0.05 mass % or more with respect to the total mass of the aluminum alloy sheet, the effect described above can be obtained. Therefore, when Fe is to be contained in the aluminum alloy sheet, the Fe content is made to be 0.05 mass % or more with respect to the total mass of the aluminum alloy sheet.

On the other hand, when the Fe content in the aluminum alloy sheet exceeds 0.5 mass % with respect to the total mass of the aluminum alloy sheet, a coarse chemical compound is formed, generating an origin of breakage, and the formability may deteriorate. Therefore, when Fe is to be contained in the aluminum alloy sheet, the Fe content is made to be 0.5 mass % or less with respect to the total mass of the aluminum alloy sheet, and preferably 0.3 mass % or less.

(Mn: 0.05 Mass % or More and 0.3 Mass % or Less)

Mn refines the grain of the ingot and the aluminum alloy sheet as a final product, and contributes to improvement of the strength. When the Mn content in the aluminum alloy sheet is 0.05 mass % or more with respect to the total mass of the aluminum alloy sheet, the effect described above can be obtained. Therefore, when Mn is to be contained in the aluminum alloy sheet, the Mn content is made to be 0.05 mass % or more with respect to the total mass of the aluminum alloy sheet.

On the other hand, when the Mn content in the aluminum alloy sheet exceeds 0.3 mass % with respect to the total mass of the aluminum alloy sheet, a coarse chemical compound is formed and the ductility may be deteriorated. Therefore, when Mn is to be contained in the aluminum alloy sheet, the Mn content is made to be 0.3 mass % or less with respect to the total mass of the aluminum alloy sheet, and preferably 0.2 mass % or less.

(Ti: More than 0 Mass % and 0.1 Mass % or Less)

Ti is an element forming a coarse chemical compound and deteriorating the mechanical property. However, since the effect of improving the formability can be obtained by refining the grain of the aluminum alloy ingot by containing Ti in the aluminum alloy sheet by a minute amount, Ti may be contained within a range defined in the JIS Standards and the like as the 6000 series alloy. Since the effect of refining the grain of the aluminum alloy ingot can be obtained by containing a minute amount of Ti in the aluminum alloy sheet, when Ti is to be contained in the aluminum alloy sheet, the Ti content is made to be more than 0 mass % with respect to the total mass of the aluminum alloy sheet.

On the other hand, when the Ti content in the aluminum alloy sheet exceeds 0.1 mass % with respect to the total mass of the aluminum alloy sheet, a coarse chemical compound is formed and the mechanical property is deteriorated. Therefore, when Ti is to be contained in the aluminum alloy sheet, the Ti content is made to be 0.1 mass % or less with respect to the total mass of the aluminum alloy sheet, and preferably 0.05 mass % or less.

(Balance: Al and Inevitable Impurities)

The Al—Mg—Si-based aluminum alloy sheet excellent in formability related to the present invention contains Mg and Si described above and preferably at least one element selected from Cu, Fe, Mn, and Ti with the balance being Al and inevitable impurities. As the inevitable impurities, B, Cr, Zn, Zr, Ni, Bi, Sn and the like can be cited.

Since B is an element forming a coarse chemical compound and deteriorating the mechanical property, B as the inevitable impurities is limited to 0.03 mass % or less.

Also, Cr, Zn, Zr, Ni, Bi, and Sn as the inevitable impurities are limited to 0.1 mass % or less respectively.

(Raw Material Sheet Structure)

On the premise of the alloy composition described above, in the present invention, the structure of the aluminum alloy sheet is specified by a differential scanning thermal analysis curve obtained by differential scanning calorimetry (DSC) as an index showing beforehand the existence state of the artificial temper aging precipitate in a member using this sheet as a raw material.

That is to say, the present invention is specified by a differential scanning thermal analysis curve obtained by differential scanning calorimetry in order to make both the breaking elongation and work hardenability excellent.

Based on such knowledge, in the present invention, in order to make both the breaking elongation and the work hardenability excellent, the height of a first exothermic peak appearing in a temperature range of 210° C. or above and below 260° C. in a differential scanning thermal analysis curve is to be made to be 20 μW/mg or more, and the height of a second exothermic peak appearing in a temperature range of 260° C. or above and 370° C. or below is to be made to be 18 μW/mg or more.

(Height of the First Exothermic Peak: 20 μW/Mg or More)

The first exothermic peak appearing in the temperature range of 210° C. or above and below 260° C. shows formation of the strengthening phase (β"). An event that the height of the first exothermic peak is high means that the strengthening phase is formed on a large scale during the differential scanning thermal analysis, and means in other words that formation of the cluster becoming the nucleus of the strengthening phase is less during the differential scanning thermal analysis.

When the height of the first exothermic peak is less than 20 μW/mg, since the strengthening phase or the cluster becoming the nucleus of the strengthening phase has been formed in a stage before the differential scanning thermal analysis, the strength becomes excessively high, and the breaking elongation and the work hardenability also deteriorate. Therefore, the height of the first exothermic peak appearing in the temperature range of 210° C. or above and below 260° C. is made to be 20 μW/mg or more.

On the other hand, although the upper limit of the height of the first exothermic peak is not limited, in terms that formation of the strengthening phase can be controlled and deterioration of the strength of the aluminum alloy sheet can be suppressed, the height of the first exothermic peak is preferably 50 μW/mg or less, and is more preferably 35 μW/mg or less.

(Height of the Second Exothermic Peak: 18 μW/Mg or More)

The second exothermic peak appearing in the temperature range of 260° C. or above and 370° C. or below shows formation of the intermediate phase (β' and the like). Also, the present inventors clarified that the height of the second exothermic peak during the differential scanning thermal analysis became high as [Si]/[Mg] increased. In other words, it was thought that an event that the height of the second exothermic peak was high expressed that [Si]/[Mg] increased, thereby the Si solid solution amount in the alloy increased, and the breaking elongation and the work hardenability improved.

When the height of the second exothermic peak is less than 18 μW/mg, it is considered that the Si solid solution amount in the alloy is small, the breaking elongation is liable to become low, and improvement of the formability by achievement of both the breaking elongation and the work hardenability cannot be obtained. Therefore, the height of the second exothermic peak appearing in the temperature range of 260° C. or above and 370° C. or below is made to be 18 μW/mg or more.

On the other hand, when the height of the second exothermic peak is excessively high, the precipitates are liable to be generated, and the breaking elongation and the work hardenability deteriorate. Therefore, although the upper limit of the height of the second exothermic peak is not limited, the height of the second exothermic peak is preferably 50 μW/mg or less.

Thus, the structure specified by the differential scanning thermal analysis curve in the stage of the raw material sheet correlates to the breaking elongation and the work hardenability of the raw material sheet, namely to the formability of the member such as the automotive panel manufactured from this raw material sheet. As a result, when the height of the exothermic peak by the differential scanning thermal analysis curve is controlled in the stage of the raw material sheet, the formability of the raw material sheet can be evaluated. In other words, the structure specified by the differential scanning thermal analysis curve in the stage of the raw material sheet can become an index of the formability in a member using this raw material sheet as a forming raw material.

(Method for Controlling Peak Height of Differential Scanning Thermal Analysis Curve)

The structure identified by the first exothermic peak of the differential scanning thermal analysis curve described above can be controlled by making the Mg content in the aluminum alloy sheet 0.3 mass % or more and 0.45 mass % or less. Also, the structure identified by the first exothermic peak of the differential scanning thermal analysis curve can be controlled by subjecting the aluminum ally cold rolled sheet whose composition is adjusted as described above to solution treatment, to quenching treatment thereafter to be cooled down to the room temperature, and, within one hour thereafter, to heat treatment of being kept for 5 hours or more and 500 hours or less at the temperature range of 30° C.-100° C., or alternatively by subjecting the aluminum alloy cold rolled sheet whose composition is adjusted as described above to solution treatment, to quenching treatment to be cooled down to the room temperature, and, within one hour thereafter, to heat treatment of being kept for 5 seconds or more and 300 seconds or less at the temperature range of 100° C.-300° C., to heat treatment of being kept for 5 hours or more and 500 hours or less at the temperature range of 30° C.-100° C.

The height of the second exothermic peak of the differential scanning thermal analysis curve described above can be controlled by adjusting the Si solid solution amount with the value of [Si]/[Mg] being made to be more than 2.5.

(Manufacturing Method)

The 6000 series aluminum alloy sheet of the present invention is a cold rolled sheet obtained by subjecting an ingot to homogenizing treatment, to hot rolling thereafter, and to cold rolling, and is manufactured by an ordinary method of being subjected further to refining such as the solution treatment. That is to say, the 6000 series aluminum alloy sheet of the present invention is manufactured by going through ordinary respective manufacturing steps of casting, homogenizing treatment, hot rolling to be made an aluminum alloy hot rolled sheet having the sheet thickness of approximately 2-10 mm, and to cold rolling to be made a cold rolled sheet having the sheet thickness of 4 mm or less. Further, it is also possible to be cooled once after the homogenizing treatment. In that case, the cooling rate after the homogenizing treatment can be 20° C./hr or more and less than 100° C./hr, reheating is executed to a prescribed temperature within the range of 350-450° C., and hot rolling can be started thereafter. At the time of cold rolling, annealing and intermediate annealing may be executed as needed.

(Solution and Quenching Treatment)

After cold rolling, the solution treatment and the quenching treatment to the room temperature following thereto are executed. With respect to this solution and quenching treatment, in order to obtain a sufficient solid solution amount of respective elements such as Mg and Si, it is preferable to heat to the solution treatment temperature of 500° C. or above and the melting temperature or below.

Also, from the viewpoint of suppressing formation of the coarse boundary compounds deteriorating the formability, it is preferable that the average cooling rate from the solution temperature to the quenching stop temperature of the room temperature is 20° C./s or more. When the average cooling rate of the quenching treatment to the room temperature after solution treatment is slow, coarse $Mg_2Si$ and single phase Si are formed, and the bending workability deteriorates. Also, the solid solution amount after being resolved reduces, and the BH property deteriorates. In order to secure this cooling rate, in the quenching treatment, the air cooling means such as the fan, the water cooling means such as the mist, spray, and immersion and the conditions are selected and used respectively.

After such solution treatment and quenching treatment thereafter to be cooled to the room temperature, within one hour, heat treatment of being kept for 5 hours or more and 500 hours or less in the temperature range of 30° C.-100° C. is executed. Alternatively, within one hour, the cold rolled sheet is subjected to heat treatment of being kept for 5 seconds or more and 300 seconds or less in the temperature range of 100° C.-300° C., and is subjected to heat treatment of being kept for 5 hours or more and 500 hours or less in the temperature range of 30° C.-100° C. Thus, the peak height of the differential scanning thermal analysis curve described above can be controlled, and the breaking elongation and the work hardenability can be secured.

EXAMPLES

Although the present embodiment will be hereinafter explained more specifically citing examples, the present invention is not limited to these examples and can be effected adding alterations within a range adaptable to the gist of the present invention, and all of them are to be included in the technical range of the present invention.

Aluminum alloy sheets having various compositions shown in Table 1 below were manufactured, were kept thereafter for 7 days at the room temperature, and were subjected thereafter to differential scanning calorimetry (DSC), and the temperature range where the exothermic peak appeared and the peak height were measured. Also, by subjecting the aluminum alloy sheets having been obtained to the tensile test, the breaking elongation was measured, and the strain hardening exponent (n-value) becoming an index of the work hardenability was measured. These results are shown in Table 2.

Further, in the column of the content of each element in Table 1, the expression of "-" shows that the content was the detection limit or small.

(Manufacturing Condition of Aluminum Alloy Sheet)

A concrete manufacturing condition of the aluminum alloy sheet will be shown below. The aluminum alloy ingots having each composition shown in Table 1 were prepared commonly by mold casting. Then, the ingots having been subjected to facing were subjected to homogenizing treatment of 540° C.×4 hours, and were thereafter subjected to hot rolling at that temperature to obtain the hot rolled sheets. The hot rolled sheets were subjected to cold rolling, and cold rolled sheets having 1.0 mm thickness were obtained.

Further, these respective cold rolled sheets were subjected to solution treatment of 1 minute at 540° C., and were water cooled thereafter to the room temperature. Within 30 minutes after this cooling, heat treatment of 1 minute or less at 200° C. or above and heat treatment of 5 hours at 50° C. were executed, and cooling was executed after the heat treatment.

With respect to each sample sheet after being left stand still for 7 days at the room temperature after these refining treatments, differential scanning calorimetry was executed.

(Differential Scanning Calorimetry)

With respect to the structure at the sheet thickness center part of the sample sheet, differential scanning calorimetry was executed, and the temperature (° C.) and the height (μW/mg) of the exothermic peak of the aluminum alloy sample sheet were measured.

The measurement condition of the differential scanning calorimetry in each measurement position of these respective sample sheets is shown below.

Testing apparatus: HITACHI DSC7020
Standard matter: Aluminum
Sample container: Aluminum
Heating condition: 10° C./min
Atmosphere: Argon (60 ml/min)
Sample weight: 39.0-42.0 mg In the present example, the differential scanning calorimetry was executed with the same condition as the one described above, the heat flow (μW) having been obtained was divided by the weight (mg) of the sample sheet to be standardized (μW/mg), thereafter, the region where the differential scanning thermal analysis curve became horizontal in the temperature range of 0-100° C. was made to be the reference level 0, and the exothermic peak height from this reference level was measured.

[Formability]

<Breaking Elongation>

As a test for judging the formability of the sample sheet described above, the tensile test was executed in accordance with JIS Z 2241, and the breaking elongation (%) was measured. The tensile test was executed at the room temperature with the No. 13B test piece (width of the parallel part 12.5 mm×gauge length distance 50 mm×sheet thickness) specified in JIS Z 2241 being taken respectively from each sample sheet. The tensile direction of the test piece was made the direction transverse to the rolling direction. Also, the tensile rate was made to be 3 mm/min up to 0.5% of the strain amount, and was made to be 20 mm/min thereafter. Further, 4 sheets of the test piece were taken from one aluminum alloy sheet, and the average value was calculated.

26% or more of the breaking elongation was considered to have passed. Also, with respect to the breaking elongation which is the evaluation of the press formability, the difference of only 1% between 25% and 26% largely affects whether the corner part or the character line where the shape of the outer panel of an automobile has become edgier or more complicated can be formed into a beautiful and sharp curved configuration without distortion and wrinkle.

<Strain Hardening Exponent (n-Value)>

As another test for judging the formability of the sample sheet described above, the tensile test was executed in accordance with JIS Z 2253, and the strain hardening exponent (n-value) was measured. With respect to the strain hardening exponent (n-value), the true strain and the true stress were calculated, the result was plotted on a logarithmic scale where the horizontal axis represented the strain and the vertical axis represented the stress, and the slope of the straight line expressed by the measurement points was calculated by the method of least squares for the logarithm of the true stress and the true strain in the plastic strain region of the nominal strain of 4-6% and was made the n-value (4-6%).

Also, 0.29 or more of the n-value was considered to have passed.

TABLE 1

| | | Chemical composition of Al-Mg-Si-based aluminum alloy sheet (mass %) * Balance: Al and inevitable impurities | | | | | | |
|---|---|---|---|---|---|---|---|---|
| | No. | Mg | Si | [Si]/[Mg] | Fe | Mn | Cu | Ti |
| Invention example | 1 | 0.45 | 1.59 | 3.53 | 0.20 | 0.08 | — | 0.02 |
| | 2 | 0.32 | 1.41 | 4.41 | 0.10 | 0.08 | — | 0.03 |
| | 3 | 0.43 | 1.42 | 3.30 | 0.10 | 0.08 | — | 0.03 |
| | 4 | 0.42 | 1.07 | 2.55 | 0.10 | 0.07 | — | 0.02 |
| | 5 | 0.32 | 1.06 | 3.31 | 0.10 | 0.07 | — | 0.02 |
| | 6 | 0.33 | 1.75 | 5.30 | 0.11 | 0.08 | — | 0.02 |
| | 7 | 0.38 | 1.29 | 3.39 | 0.10 | 0.08 | — | 0.03 |
| | 8 | 0.39 | 1.31 | 3.36 | 0.10 | 0.08 | 0.52 | 0.03 |
| Comparative example | 1 | 0.66 | 1.54 | 2.33 | 0.18 | 0.07 | — | 0.02 |
| | 2 | 0.49 | 1.72 | 3.51 | 0.17 | 0.07 | 0.01 | 0.02 |
| | 3 | 0.43 | 1.05 | 2.44 | 0.12 | 0.08 | — | — |
| | 4 | 0.55 | 1.45 | 2.64 | 0.11 | 0.08 | — | 0.02 |
| | 5 | 0.65 | 1.45 | 2.23 | 0.11 | 0.08 | — | 0.02 |
| | 6 | 0.28 | 0.50 | 1.79 | 0.15 | 0.08 | 0.01 | 0.02 |

* "—" 2 shows the detection limit or less.

TABLE 2

| | | Aluminum alloy sheet structure after being kept for 7 days at room temperature (Differential scanning thermal analysis curve) | | | | Aluminum alloy sheet property after being kept for 7 days at room temperature | |
|---|---|---|---|---|---|---|---|
| | No. | First exothermic peak temperature (° C.) | First exothermic peak height (μW/mg) | Second exothermic peak temperature (° C.) | Second exothermic peak height (μW/mg) | Breaking elongation (%) | n-value (4-6%) |
| Invention example | 1 | 236 | 31 | 289 | 45 | 27 | 0.29 |
| | 2 | 241 | 25 | 288 | 43 | 27 | 0.30 |
| | 3 | 237 | 28 | 287 | 44 | 30 | 0.29 |
| | 4 | 239 | 27 | 294 | 19 | 28 | 0.30 |
| | 5 | 241 | 22 | 297 | 26 | 27 | 0.31 |
| | 6 | 237 | 26 | 293 | 39 | 27 | 0.30 |
| | 7 | 237 | 28 | 294 | 34 | 28 | 0.30 |
| | 8 | 240 | 20 | 284 | 29 | 29 | 0.30 |
| Comparative example | 1 | 237 | 11 | 310 | 16 | 26 | 0.26 |
| | 2 | 232 | 18 | 290 | 32 | 28 | 0.27 |
| | 3 | 240 | 21 | 293 | 12 | 25 | 0.29 |
| | 4 | 236 | 14 | 306 | 22 | 26 | 0.27 |
| | 5 | 236 | 12 | 311 | 15 | 26 | 0.26 |
| | 6 | — | — | 277 | 9 | 23 | 0.29 |

* "—" shown in Comparative Example No. 6 shows that the first exothermic peak did not appear.

As shown in Table 1 and Table 2, in the invention examples No. 1 to No. 8, since the chemical composition of the aluminum alloy sheet was within the range specified in the present invention, the temperature and the peak height of the first exothermic peak and the temperature and the peak height of the second exothermic peak in the differential scanning thermal analysis curve fall within the range specified in the present invention, and both the breaking elongation and the n-value became an excellent value.

To be more specific, the breaking elongation became a high value of 26% or more, the n-value became a high value of 0.29 or more, and the formability became excellent.

In the comparative examples No. 1 and No. 5, since the Mg content of the aluminum alloy sheet exceeded the upper limit of the range of the present invention and [Si]/[Mg] was 2.5 or less, both the first exothermic peak height and the second exothermic peak height became less than the lower limit of the range of the present invention. As a result, the n-value became small.

In the comparative examples No. 2 and No. 4, since the Mg content of the aluminum alloy sheet exceeded the upper limit of the range of the present invention, the first exothermic peak height became less than the lower limit of the range of the present invention. As a result, the n-value became low.

In the comparative example No. 3, since [Si]/[Mg] was 2.5 or less, the second exothermic peak height became less than the lower limit of the range of the present invention. As a result, the breaking elongation deteriorated.

In the comparative example No. 6, since the Si content of the aluminum alloy sheet was less than the lower limit of the range of the present invention and [Si]/[Mg] was 2.5 or less, the first peak did not appear and the second exothermic peak height became less than the lower limit of the range of the present invention. As a result, the breaking elongation deteriorated. Also, in the comparative example No. 6, since the first peak did not appear, "the first exothermic peak temperature" and "the first exothermic peak height" in the comparative example No. 6 of Table 2 are shown by "-".

The differential scanning thermal analysis curves of the invention example No. 1, the invention example No. 2, and the comparative example No. 1 are shown in FIG. 1. In FIG. 1, the bold solid line shows the invention example No. 1, the bold dotted line (broken line) shows the invention example No. 2, and the thin dotted lime shows the comparative example No. 1.

As shown in FIG. 1, in the invention examples No. 1 and No. 2, the first exothermic peak appeared within the temperature range of 210° C. or above and below 260° C., and the height thereof was 20 μW/mg or more. Also, the second exothermic peak appeared within the temperature range of 260° C. or above and 370° C. or below, and the height thereof was 18 μW/mg or more.

On the other hand, in the comparative example No. 1, although the first exothermic peak and the second exothermic peak appeared within the prescribed temperature range, the height of them was low, and excellent formability could not be obtained.

What is claimed is:

1. An Al—Mg—Si-based aluminum alloy sheet, comprising:

Mg: 0.32 mass % or more and 0.45 mass % or less; and

Si: 0.6 mass % or more and 1.75 mass % or less, with the balance being Al and inevitable impurities, wherein when content of the Mg is expressed [Mg] in terms of mass % and content of the Si is expressed [Si] in terms of mass %, [Si]/[Mg] is more than 2.5, a height of a first exothermic peak appearing in a temperature range of 210° or above and below 260° C. in a differential scanning thermal analysis curve is 20 μW/mg or more, and a height of a second exothermic peak appearing in a temperature range of 260° C. or above and 370° C. or below in a differential scanning thermal analysis curve is 18 μW/mg or more.

2. The Al—Mg—Si-based aluminum alloy sheet according to claim 1, further comprising:

at least one element selected from Cu, Fe, Mn, and Ti within a range of

Cu: more than 0 mass % and 0.8 mass % or less,

Fe: 0.05 mass % or more and 0.5 mass % or less,

Mn: 0.05 mass % or more and 0.3 mass % or less, and

Ti: more than 0 mass % and 0.1 mass % or less.

3. The Al—Mg—Si-based aluminum alloy sheet according to claim 1, wherein the height of a first exothermic peak appearing in a temperature range of 210° C. or above and below 260° C. in a differential scanning thermal analysis curve is 20 μW/mg to 50 μW/mg.

4. The Al—Mg—Si-based aluminum alloy sheet according to claim 1, wherein the height of a first exothermic peak appearing in a temperature range of 210° C. or above and below 260° C. in a differential scanning thermal analysis curve is 20 μW/mg to 35 μW/mg.

5. The Al—Mg—Si-based aluminum alloy sheet according to claim 1, wherein the height of a second exothermic peak appearing in a temperature range of 260° C. or above and 370° C. or below in a differential scanning thermal analysis curve is 18 μW/mg to 50 μW/mg.

6. The Al—Mg—Si-based aluminum alloy sheet according to claim 1, comprising Si: 1.0 mass % to 1.6 mass %.

7. The Al—Mg—Si-based aluminum alloy sheet according to claim 1, comprising Si: 1.2 mass % to 1.5 mass %.

8. The Al—Mg—Si-based aluminum alloy sheet according to claim 1, wherein when content of the Mg is expressed [Mg] in terms of mass % and content of the Si is expressed [Si] in terms of mass %, [Si]/[Mg] is more than 2.7.

9. The Al—Mg—Si-based aluminum alloy sheet according to claim 1, wherein when content of the Mg is expressed [Mg] in terms of mass % and content of the Si is expressed [Si] in terms of mass %, [Si]/[Mg] is more than 3.0.

10. The Al—Mg—Si-based aluminum alloy according to claim 1, comprising:

Mg: 0.33 mass % or more and 0.45 mass % or less.

11. The Al—Mg—Si-based aluminum alloy according to claim 1, comprising:

Mg: 0.38 mass % or more and 0.45 mass % or less.

* * * * *